United States Patent [19]

Aoyama

[11] 4,114,577

[45] Sep. 19, 1978

[54] EXHAUST GAS RECIRCULATION CONTROL SYSTEM

[75] Inventor: Syunichi Aoyama, Yokohama, Japan

[73] Assignee: Nissan Motor Company, Limited, Japan

[21] Appl. No.: 787,161

[22] Filed: Apr. 13, 1977

[30] Foreign Application Priority Data

Apr. 16, 1976 [JP] Japan ..... 51-43263

[51] Int. Cl.[2] ..... F02M 25/06

[52] U.S. Cl. ..... 123/119 A

[58] Field of Search ..... 123/119 A

[56] References Cited

U.S. PATENT DOCUMENTS

| | | | |
|---|---|---|---|
| 3,762,384 | 10/1973 | Day et al. | 123/119 A |
| 3,834,366 | 9/1974 | Kingsbury | 123/119 A |
| 3,880,129 | 4/1975 | Hollis | 123/119 A |
| 3,982,515 | 9/1976 | Bradshaw | 123/119 A |

*Primary Examiner*—Carlton R. Croyle
*Assistant Examiner*—Michael Koczo, Jr.
*Attorney, Agent, or Firm*—Lane, Aitken, Dunner & Ziems

[57] ABSTRACT

An exhaust gas recirculation (EGR) control valve provided with an extension which is inserted into a restriction, formed in the EGR passageway upstream of the EGR control valve, to reduce the effective cross sectional area of the restriction and therefore the EGR ratio when the pressure in the EGR passageway between the restriction and the EGR control valve is reduced below a predetermined value due to increases in an engine suction vacuum during low load engine operating conditions.

9 Claims, 4 Drawing Figures

EXHAUST GAS RECIRCULATION CONTROL SYSTEM

BACKGROUND OF THE INVENTION

1. Field of the Invention

The present invention relates generally to an exhaust gas recirculation (EGR) control system of a type which comprises an EGR passageway having a restriction formed upstream of the EGR control valve to define a chamber between the restriction and the EGR control valve and particularly to an EGR control system of this type in which the EGR control valve is provided with an extension which is inserted into the restriction to reduce the effective cross sectional area thereof and therefore the recirculated exhaust gas flow and the EGR ratio when the pressure in the chamber is reduced below a predetermined value due to increases in an engine suction vacuum during low load engine operating conditions.

2. Description of the Prior Art

As is well known in the art, an exhaust gas recirculation (EGR) control system serves to reduce the production of nitrogen oxides (NOx) in combustion of an internal combustion engine by controlling the maximum combustion temperature below a certain level by recirculating or feeding into air drawn by the engine a portion of exhaust gas emitted from the engine. Accordingly, it is necessary to control the flow of recirculated engine exhaust gas to an optimum value in accordance with engine operating conditions so that the recirculated exhaust gas flow exerts no bad influence on the operating performance or driveability and the fuel consumption of the engine.

It is usually desirable to maintain at about a predetermined or constant value the EGR ratio, that is, the ratio of the recirculated exhaust gas flow to the flow of air taken into the engine. As an expedient for attaining this purpose, there is proposed an EGR control system of a back pressure proportioning type as shown in FIG. 1 of the accompanying drawings. The conventional EGR control system comprises an EGR passageway 1 formed therein with a restriction 2 for controlling the recirculated exhaust gas flow, an EGR control valve 3 disposed in the EGR passageway 1 downstream of the restriction 2 for controlling the pressure Pe in the EGR passageway 1 between the restriction 2 and the EGR control valve 3, and a diaphragm unit including a flexible diaphragm 4 which is operatively connected to the EGR control valve 3 and has on a side thereof a vacuum working chamber 5 fed with an engine suction vacuum. A pressure regulating valve 6 is provided which controls the suction vacuum into the vacuum working chamber by controlling in accordance with the pressure P*e* the flow of atmospheric air admitted for diluting the suction vacuum from the engine. the EGR control valve 3 is feedback controlled by the thus controlled suction vacuum in the vacuum working chamber to maintain the pressure P*e* constant during all engine operating conditions. Since the recirculated exhaust gas flow depends on the difference between the pressure P*b* in the EGR passageway upstream of the restriction and the pressure P*e* and the pressure P*e* is maintained constant, the recirculated exhaust gas flow is represented as a function of the pressure P*b* which is about proportional to the engine taken air flow. As a result, the recirculated exhaust gas flow is controlled to about a constant ratio to the engine taken air flow.

However, when the EGR ratio is controlled to about a constant value throughout all engine operating conditions in this manner, there is a tendency that the stability of operation and the fuel consumption of the engine are degraded during low load engine operating conditions. Since generally, combustion conditions are apt to be degraded to make the operating performance of the engine unstable owing to decreases in the compression pressure of an engine air-fuel mixture and increases in residual gas and furthermore the production of nitrogen oxides is extremely reduced during low load engine operating conditions, it becomes almost unnecessary to perform the EGR. However, it is undesirable to completely stop the EGR since air pollution is promoted and the smoothness of the operating characteristics is lost.

SUMMARY OF THE INVENTION

It is, therefore, an object of the invention to provide an EGR control system which is constructed and arranged to reduce the EGR ratio to a proper value surely and without losing the smoothness of the operating characteristics during low load engine operating conditions.

This purpose is accomplished by providing the EGR control valve with an extension which is inserted into the restriction to reduce the effective cross sectional area thereof when the pressure P*e* is reduced below a predetermined value due to increases in the suction vacuum during low load engine operating conditions.

BRIEF DESCRIPTION OF THE DRAWINGS

This and other features and advantages of the invention will become more apparent from the following detailed description taken in connection with the accompanying drawings in which.

DESCRIPTION OF THE SPECIFIC EMBODIMENTS

Figure 1:
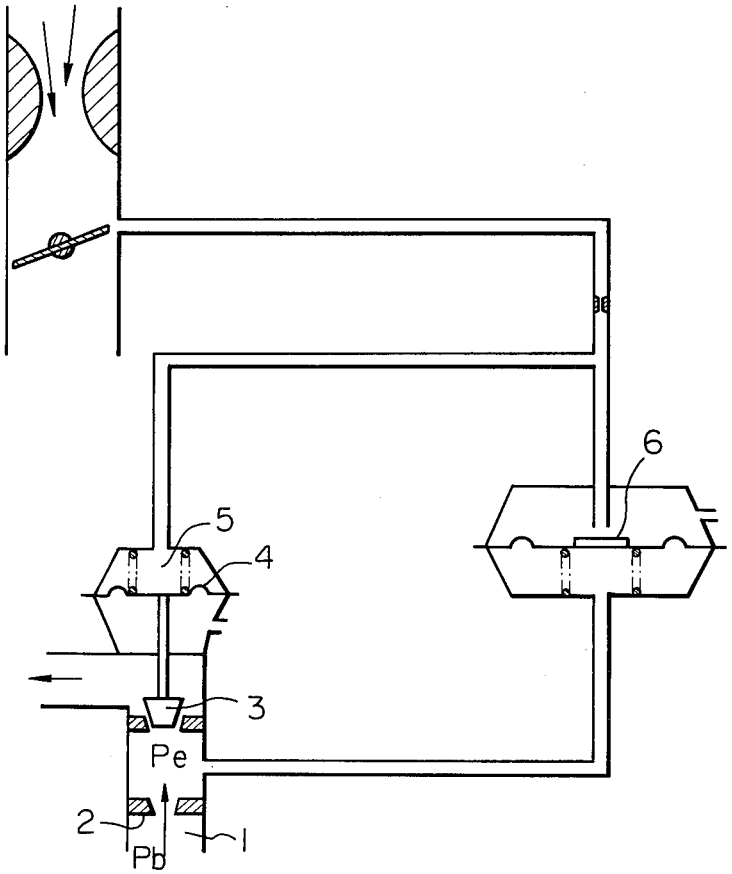
FIG. 1 is a schematic view of the conventional EGR control system as per the introduction of the present specification.
Figure 2:
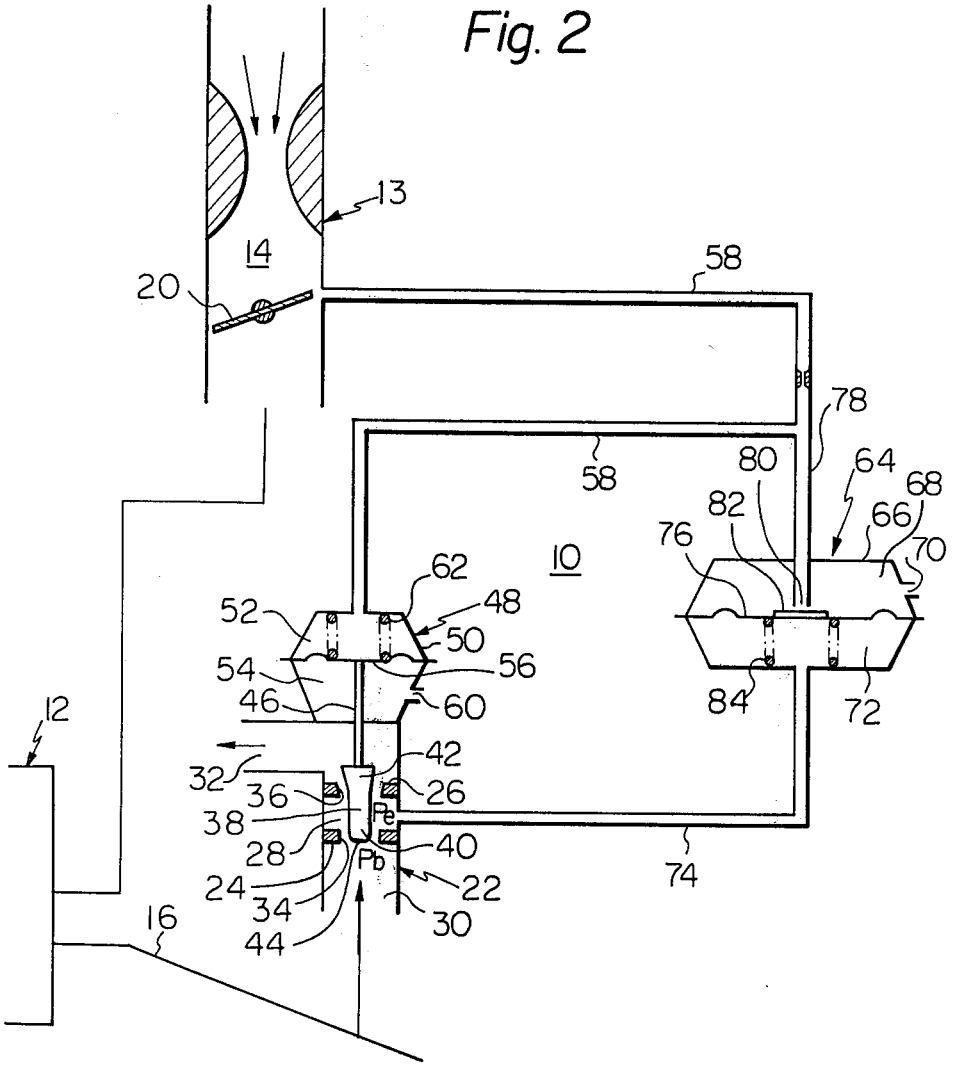
FIG. 2 is a schematic view of a first preferred embodiment of an EGR control system according to the invention.

Referring to FIG. 2 of the drawings, there is shown an exhaust gas recirculation (EGR) control system according to the invention. The EGR control system, generally designated by the reference numeral 10, is combined with an internal combustion engine 12 including a carburetor 13, an intake passageway 14 passing through the carburetor 13 and providing communication between the atmosphere and the engine 12 for conducting air thereinto, and an exhaust gas passageway 16 providing communication between the engine 12 and the atmosphere for conducting thereto exhaust gas emitted from the engine 12. The intake passageway 14 has a venturi 18 formed therein and a throttle valve 20 rotatably mounted downstream of the venturi 18. The EGR control system 10 is of a back pressure proportioning type and comprises an EGR passageway 22 providing communication between the exhaust gas passageway 16 and the intake passageway 14 downstream of the throttle valve 20 for recirculating or conducting engine exhaust gas into the intake passageway 14. The EGR passageway 22 is formed therein with partition members 24 and 26 which are arranged adjacent to each other and divide the EGR passageway 22 into a chamber 28 defined between the partition members 24 and 26 and upstream and downstream parts 30 and 32 located respectively upstream and downstream of the chamber 28. The partition member 24 is formed therethrough with an orifice 34 which provides communication between the upstream part 30 and the chamber 28 and forms together with the partition member 24 a restriction of the EGR passageway 22 which restricts the flow of recirculated engine exhaust gas. The partition member 26 is formed therethrough with an aperture 36 which provides communication between the chamber 28 and the downstream part 32.

An EGR control valve 38 extends through the aperture 36 and is movable in the chamber 28 and the orifice 34. The EGR control valve 38 is in the form of a plunger and has an upstream section or extension 40 serving to reduce the effective cross sectional area of the orifice 34 or the degree of opening of thereof to a predetermined value during low load engine operating condition and having the external cross sectional area smaller than the cross sectional area of the oricice 34, and a downstream section 42 to which the upstream section 40 is fixedly connected and from which the upstream section 40 projects toward the upstream part 30. The downstream section 42 serves to vary the effective cross sectional area of the aperture 36 in accordance with variations in an engine suction vacuum and is tapered toward the chamber 28. The upstream section 40 has a free end 44 and is tapered from the vicinity of the free end 44 thereto. This is to prevent the EGR ratio from being abruptly and largely varied and the smoothness of the operation from being lost when the upstream section is inserted into the orifice 34. The EGR control valve 38 has a first position in which the upstream section 40 is located apart from the orifice 34 and a second position in which the upstream section 40 is inserted into the orifice 34. The EGR control valve 38 includes a valve stem 46 extending therefrom externally of the EGR passageway 22 and a diaphragm unit 48 for operating the EGR control valve 38. The diaphragm unit 48 comprises a housing 50 having two chambers 52 and 54, and a flexible diaphragm 56 separating the chambers 52 and 54 from each other. The chamber 52 communicates through a passage 58 with a vacuum source such as, for example, the intake passageway 14 at a point which is located on the atmospheric or upstream side of the throttle valve 20 fully closed and on the downstream or suction vacuum side of the throttle valve 20 opened above a certain amount. The chamber 54 communicates with the atmosphere through an opening 60. A spring 62 is provided to urge the diaphragm 56 in a direction opposed by the atmospheric pressure in the chamber 54. The diaphragm 56 is operatively connected to the EGR control valve 38 through the valve stem 46 so that the valve 38 is moved to vary the effective cross sectional area of the aperture 36 in accordance with a vacuum in the chamber 52.

A pressure regulating valve assembly 64 is provided to control the vacuum in the chamber 52 in accordance with the pressure P*e* of engine exhaust gas in the chamber 28. The pressure regulating valve assembly 64 comprises a housing 66 having a chamber 68 communicating with the atmosphere through an opening 70 and a chamber 72 communicating with the chamber 28 through a passage 74, and a flexible diaphragm 76 separating the chambers 68 and 72 from each other. A passage 78 branches off from the passage 58 into the chamber 68 and has an open end 80 located near the diaphragm 76. A pressure regulating valve 82 is disposed in the chamber 68 adjacent to and confronting t the open end 80 and movably relative to the open end 80. The diaphragm 76 is fixedly and operatively connected to the regulating valve 82 so that the regulating valve 82 is moved to vary the degree of opening of the open end 80. A spring 84 is provided to urge the diaphragm 76 in a direction opposed by the atmospheric pressure in the chamber 68.

The EGR control system 10 thus described is operated as follows:

When the exhaust gas pressure P*e* in the chamber 28 and therefore in the chamber 72 is increased due to decreases in the suction vacuum, the diaphragm 76 is moved in opposition to the force of the spring 84 into a position in which the pressure regulating valve 82 reduces the degree of opening of the open end 80 and therefore the flow of atmospheric air admitted into the passage 78 for diluting the suction vacuum fed from the intake passageway 14 into the chamber 52. As a result, the vacuum in the chamber 52 is increased to move the diaphragm 56 into a position in which the degree of opening of the EGR control valve 38 is increased or the EGR control valve 38 increases the effective cross sectional are of the aperture 36 to reduce the exhaust gas pressure P*e* in the chamber 28. On the contrary, when the exhaust gas pressure P*e* in the chamber 28 is reduced due to decreases in the exhaust gas pressure in the downstream part 32, the degree of opening of the EGR control valve 38 is reduced or the EGR control valve 38 is moved to reduce the effective cross sectional area of the aperture 36 to increase the exhaust gas pressure P*e* in the chamber 28 by operation reverse to that mentioned above. As a result, the exhaust gas pressure P*e* in the chamber 28 is maintained about constant independently of the exhaust gas pressure in the downstream part 32 and therefore the suction vacuum. Generally, the recirculated exhaust gas flow depends on the pressure differential (P*b*-P*e*) of the upstream part 30 and the chamber 28 and the exhaust gas pressure P*b* in the upstream part 30 is about proportional to the exhaust gas pressure in the exhaust gas passageway 16. Since the exhaust gas pressure P*e* is constant as mentioned above in this system, the recirculated exhaust gas flow is proportional to the exhaust gas pressure in the exhaust gas passageway 16 and therefore to the engine taken air flow proportional to the exhaust gas pressure, so that the recirculated exhaust gas flow is increased in accordance with increases in the engine taken air flow. Accordingly, the EGR ratio is maintained at a predetermined or constant value independently of the suction vacuum.

The recirculated exhaust gas flow and the EGR ratio depend on and have relatively large and small values in accordance with the effective cross sectional area of the orifice 34 and therefore the position of the EGR control valve 38. When the engine 12 is in relatively high load operating conditions in which the suction vacuum is below a predetermined value, the EGR control valve 38 is moved by the vacuum in the chamber 52 controlled by the pressure regulating valve 82 into the first position in which the free end 44 of the upstream section 40 is located in the chamber 28 not to reduce the effective cross sectional area of the orifice 34 and therefore at this time the recirculated exhaust gas flow and the EGR ratio have the relatively large values. When the engine 12 is in relatively low load operating conditions in which the suction vacuum is increased above the predetermined value, the EGR control valve 38 is moved by the vacuum in the chamber 52 controlled by the pressure regulating valve 82 into the second position in which the upstream section 40 is located in the orifice 34 to reduce the effective cross sectional area thereof and therefore at this time the recirculated exhaust gas flow and the EGR ratio have the relatively small values. As a result, the operating performance and the fuel consumption of the engine 12 are prevented from being degraded during low load engine operating conditions.

Figure 3:
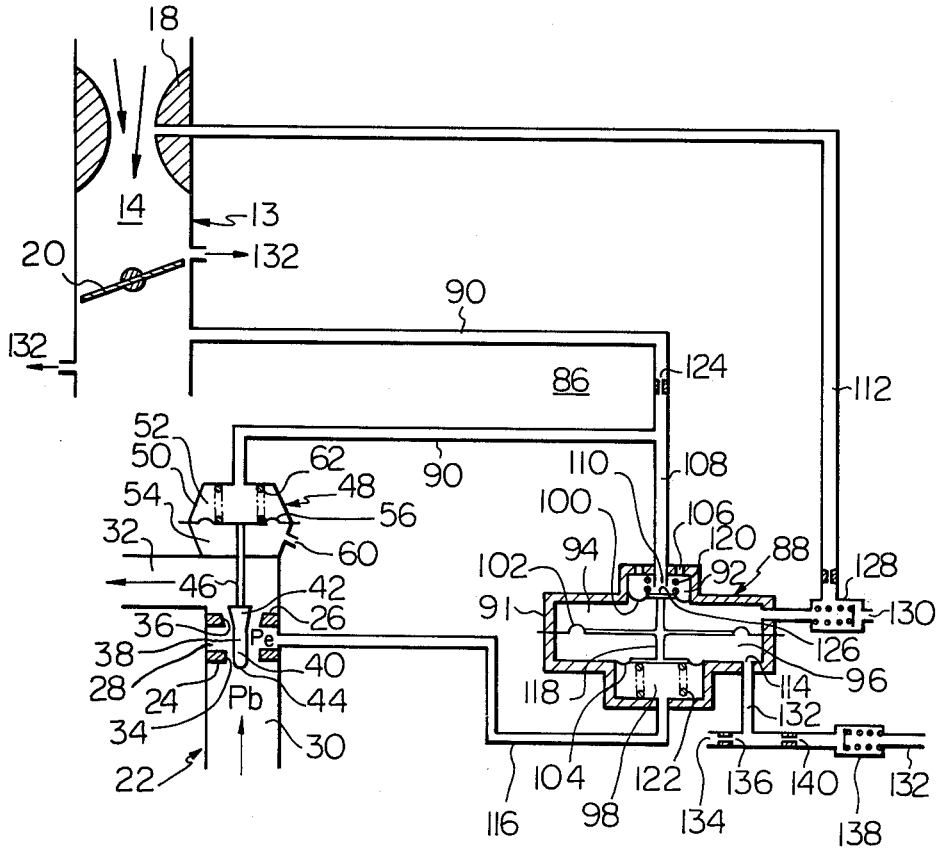
FIG. 3 is a schematic view of a second preferred embodiment of an EGR control system according to the invention.

Referring to FIG. 3 of the drawings, there is shown an EGR control system, according to the invention, of a type in which the exhaust gas pressure P*e* in the chamber 28 is controlled to values varied in accordance with variations in the vacuum in the venturi 18. In FIG. 3, like component elements and parts are designated by the same reference numerals as those used in FIG. 2. The EGR control system, generally designated by the reference numeral 86, is characterized in that the EGR control valve 38 is operated in response to the vacuum in the chamber 52 controlled by a pressure regulating valve assembly 88 in lieu of the valve assembly 64. In this embodiment, the chamber 52 of the diaphragm unit 48 communicates with a vacuum source such as, for example, the intake passageway 14 downstream of the throttle valve 20 through a passage 90 as shown in FIG. 3. Alternatively, the chamber 52 may communicate with the intake passageway 14 at the point as described with reference to and shown in FIG. 2.

The pressure regulating valve assembly 88 comprises a housing 91 having therein four chambers 92, 94, 96 and 98, and three flexible diaphragms 100, 102 and 104. The diaphragm 100 separates the chambers 92 and 94 from each other. The diaphragm 102 separates the chambers 94 and 96 from each other. The diaphragm 104 separates the chambers 96 and 98 from each other. The chamber 92 communicates with the atmosphere through an opening 106 and with the passage 90 through a passage 108 and an inlet port 110. The chamber 94 communicates with the venturi 18 through a passage 112. The chamber 96 communicates with the atmosphere through an opening 114. The chamber 98 communicates with the chamber 28 of the EGR passageway 22 through a passage 116. The diaphragm 102 has a working or pressure acting surface area larger than that of each of the diaphragms 100 and 104. The diaphragms 100, 102 and 104 are fixedly connected to each other by a rod 118 so that they are operated as one body. Springs 120 and 122 are provided to urge the integral diaphragms 100, 102 and 104 in opposite directions. An orifice 124 is formed in the passage 90 on the intake passageway side of the junction of the passages 90 and 108. A pressure regulating valve 126 is located in the chamber 92 movably relative to the port 110 to control the flow of atmospheric air admitted into the port 110 and is fixedly and operatively connected to the diaphragm 100.

A relief valve 128 is disposed in the passage 112 and the passage 112 has a port 130 providing communication between the passage 112 and the atmosphere. The relief valve 128 closes and opens the port 130 to obstruct and provide communication between the passage 112 and the atmosphere when the venturi vacuum is below and above a predetermined value, respectively.

A passage 132 provides communication between the opening 114 and the intake passageway 14 downstream of the throttle valve 20 and/or just upstream of the throttle valve 20 in its fully closed position to conduct into the chamber 96 the suction vacuum and/or a so-called VC pressure which is the atmospheric pressure when the throttle valve 20 is fully closed and is the suction vacuum when the throttle valve 20 is opened above a certain amount. The passage 132 has a port 134 providing communication between the passage 132 and the atmosphere and formed therein with an orifice 136. A check valve 138 is disposed in the passage 132 on the intake passageway side of the port 134 and closes and opens the passage 132 to obstruct and provide communication between the chamber 96 and the intake passageway 14 when either or the sum of the suction vacuum and the VC pressure is below and above a predetermined value, respectively. An orifice 140 is formed in the passage 132 between the port 134 and the check valve 138. If desired, the relief valve 128, the port 130, the passage 132 and the check valve 138 can be dispensed with.

The EGR control system 86 thus described is operated as follows:

When the vacuum in the venturi 18 and therefore in the chamber 94 is increased, the diaphragms 100, 102 and 104 are integrally moved into a position in which the pressure regulating valve 126 reduces the degree of opening of the port 110 to reduce the flow of atmospheric air admitted into the passage 108 for diluting the suction vacuum conducted into the chamber 52. As a result, the vacuum in the chamber 52 is increased to move the EGR control valve 38 in a direction to increase the effective cross sectional area of the aperture 36 to reduce the exhaust gas pressure P*e* in the chamber 28. On the contrary, when the venturi vacuum and therefore the vacuum in the chamber 94 are reduced, the pressure regulating valve 126 is moved to increase the flow of atmospheric air admitted into the passage 108. As a result, the vacuum in the chamber 52 is reduced to move the EGR control valve 38 in a direction to reduce the effective cross sectional area of the aperture 36 to increase the exhaust gas pressure P*e* in the chamber 28. Accordingly, the pressure differential P*b*-P*e* of the upstream part 30 and the chamber 28 is increased and reduced in accordance with increases and decreases in the venturi vacuum and therefore the engine taken air flow, respectively. Therefore, the recirculated exhaust gas flow is increased and reduced in accordance with increases and decreases in the pressure differential P*b*-P*e* and in the engine taken air flow, respectively. As a result, the EGR ratio is maintained at a predetermined or constant value.

When the pressure P*e* in the chamber 28 is reduced irrespective of the position of the EGR control valve 38 relative to the aperture 36 and therefore the venturi vacuum, the diaphragm 104 is moved in response to decreases in the pressure in the chamber 98 in a direction in which the pressure regulating valve 126 increases the degree of opening of the inlet port 110 to reduce the vacuum in the chamber 52. As a result, the EGR control valve 38 is moved in a direction to reduce the degree of opening of the aperture 36 to increase the pressure P*e* in the chamber 28 to a former value. On the contrary, when the pressure P*e* is increased regardless of the degree of opening of the aperture 36, the pressure regulating valve 126 is moved in a direction to reduce the degree of opening of the inlet port 110. As a result, the EGR control valve 38 is moved in a direction to reduce the degree of opening of the aperture 36 to reduce the pressure P*e* in the chamber 28 to a former value.

When the pressure P*b* in the upstream part 30 is varied due to the temperature of the engine exhaust gas, the resistance of the exhaust gas passageway 16 to the engine exhaust gas flow, secondary air fed into the exhaust system of the engine 12 or the like independently of the engine taken air flow, since the recirculated exhaust gas flow depends upon the pressure differential P*b*-P*e* of the upstream part 30 and the chamber 28 and therefore the variations in the pressure differential P*b*-P*e* due to variations in the pressure P*b* can be almost neglected, the recirculated exhaust gas flow is not almost affected by variations in the pressure P*b*. As a result, the control of the recirculated exhaust gas flow is stabilized.

When the engine 12 is in low load operating conditions in which the suction vacuum is increased above a predetermined value, the pressure P*e* in the chamber 28 and therefore the pressure in the chamber 98 are reduced to move the pressure regulating valve 126 in a direction to increase the degree of opening of the inlet port 110 to reduce the vaccum in the chamber 52. As a result, the upstream section 40 of the EGR control valve 38 is inserted into the orifice 34 to reduce of the degree of opening thereof. Accordingly, the recirculated exhaust gas flow and the EGR ratio are reduced to proper values during low load engine operating conditions.

When the venturi vacuum is increased above the predetermined value, the relief valve 128 is opened to admit atmospheric air into the chamber 94 to prevent the degree of opening of the inlet port 110 from being reduced above a predetermined amount even if the venturi vacuum is increased above the predetermined value. Accordingly, the pressure P*e* in the chamber 28 is prevented from being reduced below a predetermined level to prevent the recirculated exhaust gas flow from being increased above a predetermined value. As a result, the EGR ratio is reduced to a proper value to prevent the fuel consumption from being increased and the operating performance from being degraded during the engine high speed and high load operating conditions.

When the engine 12 is in a high speed and low load operating condition in which either or the sum of the suction vacuum and the VC pressure is increased above the predetermined value, the check valve 138 is opened to admit the venturi vacuum and/or the VC pressure into the chamber 96 to cancel the venturi vacuum in the chamber 68 a certain degree. Accordingly, the degree of opening of the EGR control valve 38 is prevented from being increased above a predetermined value to keep the pressure P*e* in the chamber 28 above a predetermined level to prevent the recirculated exhaust gas flow from being increased above a certain amount. As a result, the EGR ratio is reduced to an adequate value to increase the stability of operation, the fuel economy and the operating performance of the engine 12 during the engine high speed and low load operating condition in which the production of nitrogen oxides (NOx) is extremely small.

Figure 4:
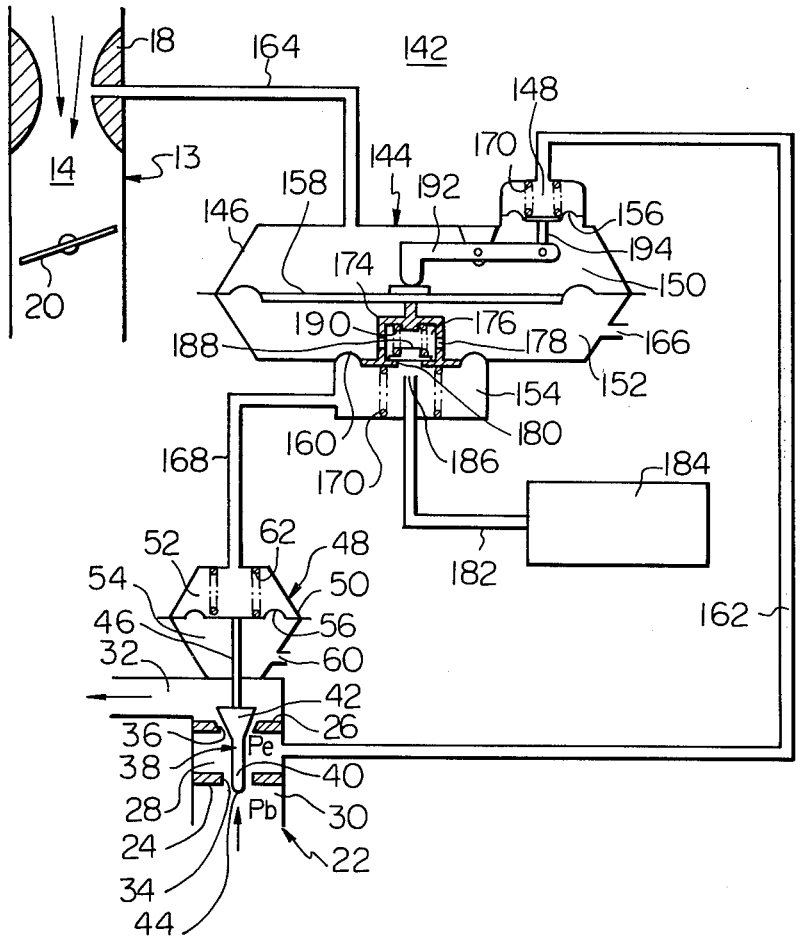
FIG. 4 is a schematic view of a third preferred embodiment of an EGR control system according to the invention.

Referring to FIG. 4 of the drawings, there is shown a further embodiment of an EGR control system according to the invention of the same type as the EGR control system 86 shown in FIG. 3. In FIG. 4, like component elements and parts are designated by the same reference numerals as those used in FIGS. 2 and 3. The EGR control system, generally designated by the reference numeral 142, is characterized in that the chamber 52 of the diaphragm unit 48 for the EGR control valve 38 is fed with a vacuum proportional to and amplified above the venturi vacuum by a vacuum amplifying device 144. The amplifying device 144 comprises a casing 146 having four chambers 148, 150, 152 and 154 therein, and three flexible diaphragms 156, 158 and 160. The diaphragm 156 separates the chambers 148 and 150 from each other. The diaphragm 158 separates the chambers 150 and 152 from each other. The diaphragm 160 separates the chambers 152 and 154 from each other and has a working or pressure acting surface area smaller than that of the diaphragm 158. The chamber 148 communicates with the chamber 28 through a passage 162, the chamber 150 communicates with the venturi 18 through a passage 164, the chamber 152 communicates with the atmosphere through an opening 166, and the chamber 154 communicates with the chamber 52 of the diaphragm unit 48 of the EGR control valve 38 through a passage 168. A spring 170 is provided to urge the diaphragm 156 in a direction opposed by the pressure in the chamber 150. A spring 172 is provided to urge the diaphragms 158 and 160 in a direction opposed by the pressure in the chamber 150. A housing 174 is located in the chamber 152 and the diaphragms 158 and 160 are fixedly connected to each other by the housing 174. The housing 174 has therein a valve chamber 176 and is formed therethrough with an aperture 178 which provides communication between the chambers 152 and 176. The diaphragm 160 is formed therethrough with an aperture 180 which provides communication between the chambers 176 and 154. A passage or conduit 182 communicates at an end with a vacuum source 184 such as a vacuum tank and has an open end 186 opening into the chamber 154 and located adjacent to the aperture 180. The cross sectional area or diameter of the aperture 180 is larger than the external cross sectional area or diameter of the conduit 182 located in the chamber 154 so that a clearance is provided between the conduit 182 and the diaphragm 160 and the conduit 182 is projectable into the chamber 176 through the aperture 180. A control valve 188 is located in the valve chamber 176 to engage against and disengage from the diaphragm 160 to close and to open the aperture 180 and to engage against and disengage from the open end 186 of the conduit 182 to close and open the open end 186. The control valve 188 closes the aperture 180 and is spaced apart from the open end 186 of the conduit 182 to open the open end 186 when is in a position as shown in FIG. 4. A spring 190 is provided to press the control valve 188 against the diaphragm 160 to close the aperture 180. The force of the spring 190 is set so that, when the diaphragm 160 is moved toward the conduit 182 with the control valve 188 engaging against the open end 186 of the conduit 182, the spring 190 allows the conduit 182 to disengage the control valve 188 from the diaphragm 160 to open the aperture 180 and the conduit 182 to project into the valve chamber 176. The intake passageway 14 may be employed to feed the suction vacuum therein into the chamber 154 as the vacuum source 184 in lieu of the vacuum tank. A lever 192 is rotatably located in the chamber 150 and engages at one end against the diaphragm 158. The diaphragm 156 is operatively connected to the other end of the lever 192 through a rod 194.

The EGR control system 142 thus described is operated as follows:

When the venturi vacuum is increased above a predetermined value, the diaphragms 158 and 160 are moved in a direction in which the control valve 188 closes the aperture 180 and increases the degree of opening of the open end 186 of the conduit 182 to increase the vacuum in the chamber 52. As a result, the EGR control valve 38 is moved into a position to increase the degree of opening of the aperture 36 to reduce the pressure P*e* in the chamber 28. On the contrary, when the venturi vacuum is reduced below the predetermined value, the diaphragms 158 and 160 are moved in a direction in which the control valve 188 closes the open end 186 of the conduit 182 and concurrently is forced by the conduit 182 to increase the degree of opening of the aperture 180 to admit atmospheric air into the chamber 154. As a result, the vacuum in the chamber 52 is reduced to move the EGR control valve 38 into a position to reduce the degree of opening of the aperture 36 to increase the pressure P*e* in the chamber 28. Accordingly, the pressure P*e* in the chamber 28 is reduced and increased in accordance with increases and decreases in the engine taken air flow, similarly to the EGR control system 86 described with respect to and shown in FIG. 3.

When the pressure P*e* in the chamber 28 is reduced below a predetermined value due to increases in the suction vacuum, the diaphragm 156 is moved away from the diaphragm 158 to force the lever 192 to move the diaphragms 158 and 160 in a direction in which the control valve 188 closes the open end 186 of the conduit 182 and is forced by the conduit 182 to increase the degree of opening of the aperture 180. As a result, the vacuum in the chamber 52 is reduced by atmospheric air to cause the EGR control valve 38 to reduce the degree of opening of the aperture 36 to restore or increase the pressure P*e* in the chamber 28 to a former value. On the contrary, when the pressure P*e* in the chamber 28 is increased above the predetermined value by decreases in the suction vacuum, the diaphragm 156 is moved toward the diaphragm 158 to allow the spring 170 to move the diaphragms 158 and 160 in a direction in which the control valve 188 closes the aperture 180 and increases the degree of opening of the open end 186 to increase the vacuum in the chamber 52. As a result, the EGR control valve 38 is moved to increase the degree of opening of the aperture 36 to restore or reduce the pressure P*e* in the chamber 28.

When the suction vacuum is increased above a predetermined value, the diaphragm 156 is moved in response to decreases in the pressure P*e* in the chamber 28 to move the diaphragms 158 and 160 into a position in which the control valve 188 is moved by the conduit 182 to open the aperture 180 a large amount to reduce the vacuum in the chamber 52 below a predetemined value. As a result, the EGR control valve 38 is moved into a position in which the upstream part 40 is inserted into the orifice 34 to reduce the effective cross sectional area thereof. Accordingly, the recirculated exhaust gas flow and the EGR ratio are reduced to proper values.

It will be thus appreciated that the invention provides an EGR control system constructed and arranged to reduce the effective cross sectional area of a restriction provided in the EGR passageway upstream of the EGR control valve to reduce the EGR ratio during high speed and low load engine operating conditions so that the driveability and the fuel consumption of the engine are improved.

What is claimed is:

1. An exhaust gas recirculation (EGR) control system in combination with an internal combustion engine including an intake passage providing communication between the atmosphere and the engine, and an exhaust gas passageway providing communication between the engine and the atmosphere, said EGR control system comprising an EGR passageway providing communication between the exhaust gas passageway and the intake passageway for recirculating thereinto exhaust gas emitted from the engine, said EGR passageway/-having provided therein a restriction for restricting said EGR passageway;

an EGR control valve which is disposed in said EGR passageway downstream of said restriction for controlling the flow of recirculated exhaust gas and defines a first chamber interposed between said restriction and said EGR control valve, and first control means for increasing and reducing the degree of opening of said EGR control valve in accordance with increases and decreases in the pressure in said first chamber due to variations in a suction vacuum in the intake passageway, respectively, in which said EGR control valve comprises an extension fixedly connected to said EGR control valve and projecting toward said restriction, said extension being located in said first chamber when the pressure in said first chamber is above a predetermined value and being inserted into said restriction to reduce the effective cross sectional area thereof and therefore an EGR ratio of the recirculated exhaust gas flow to the flow of air taken by the engine when the pressure in said first chamber is reduced below said predetermined value.

2. An EGR control system as claimed in claim 1, in which said extension has a free end first inserted into said restriction when said extension is inserted thereinto, said extension being tapered from the vicinity of said free end thereto.

3. An EGR control system as claimed in claim 1, in which said control means comprises a second chamber communicating with a vacuum source, a third chamber communicating with the atmosphere, a first flexible diaphragm separating said second and third chambers from each other a pressure regulating valve assembly comprising a second flexible diaphragm having on one side thereof a fourth chamber communicating with said first chamber, passage means communicating with said second chamber and having an open end which is located near the other side of said second diaphragm and communicates with the atmosphere, and a pressure regulating valve confronting said open end, said second diaphragm being operatively connected to said pressure regulating valve so that said pressure regulating valve reduces and increases the flow of atmospheric air, admitted into said passage means for controlling the vacuum in said second chamber, in accordance with increases and decreases in the pressure in said first chamber respectively, said first diaphragm being operatively connected to said EGR control valve so that it increases and reduces the degree of opening of said EGR control valve in accordance with increases and decreases in the vacuum in said second chamber, respectively.

4. An EGR control system as claimed in claim 1, in which the intake passageway has formed therein a venturi, further comprising second control means for increasing and reducing the pressure in said first chamber in accordance with decreases and increases in the vacuum in said venturi, respectively and combined with said first control means.

5. An EGR control system as claimed in claim 4, in which said combined first and second control means comprises a second chamber communicating with a vacuum source to receive a vacuum therein, a third chamber communicating with the atmosphere, a first flexible diaphragm separating said second and third chambers from each other and operatively connected to said EGR control valve so that said EGR control valve is operated in opposite directions to increase and reduce the pressure in said first chamber in response to decreases and increases in the vacuum in said second chamber, respectively, passage means communicating with said second chamber and having an inlet port communicating with the atmosphere for admitting into said passage means atmospheric air for diluting the vacuum in said second chamber, a pressure regulating valve located movably relative to said inlet port of said passage means for controlling the flow of atmospheric air admitted into said inlet port, a fourth chamber communicating with said venturi to receive the venturi vacuum therefrom, a fifth chamber communicating with the atmosphere, a sixth chamber communicating with said first chamber to receive the pressure therein, a second flexible diaphragm separating the atmosphere and said fourth chamber from each other, a third flexible diaphragm separating said fourth and fifth chambers from each other, and a fourth flexible diaphragm separating said fifth and sixth chambers from each other and fixedly connected to said second and third diaphragms, said second diaphragm being operatively connected to said pressure regulating valve so that said pressure regulating valve is operated in opposite directions to reduce and increase the flow of atmospheric air into said inlet port in response to increases and decreases in the venturi vacuum in said fourth chamber and in the opposite directions to reduce and increase the flow of atmospheric air into said inlet port in said sixth chamber.

6. An EGR control system as claimed in claim 5, in which said combined first and second control means further comprises second passage means providing communication between said venturi and said fourth chamber, and a relief valve disposed in said second passage means and providing communication between said fourth chamber and the atmosphere in response to a vacuum in said fourth chamber above a predetermined value for preventing the vacuum in said fourth chamber from being increased in excess of said predetermined value for preventing said pressure regulating valve from reducing the flow of atmospheric air into said inlet port below a predetermined level during a high speed and high load operating condition of said engine.

7. An EGR control system as claimed in claim 5, in which said intake passageway has a throttle valve rotatably mounted therein, said combined first and second control means further comprises second passage means providing communication between said fifth chamber and said intake passageway downstream of said throttle valve, and a check valve disposed in said second passage means and closing said second passage means in response to a suction vacuum in said second passage means below a predetermined value and opening said second passage means in response to a suction vacuum in said second passage means above said predetermined value to prevent said pressure regulating valve from reducing the flow of atmospheric air into said inlet port below a predetermined level during a high speed and low load operating condition of the engine.

8. An EGR control system as claimed in claim 7, in which said second passage means further communicates with said intake passageway at a location which is on the atmospheric side of the throttle valve fully closed and is varied to the suction vacuum side of the throttle valve opened a certain amount.

9. An EGR control system as claimed in claim 4, in which said combined first and second control means comprises a second chamber receiving a vacuum, a third chamber communicating with the atmosphere, a first flexible diaphragm separating said second and third chambers from each other and operatively connected to said EGR control valve so that said EGR control valve is operated in opposite directions to increase and reduce the pressure in said first chamber in response to decreases and increases in the vacuum in said second chamber, respectively, a fourth chamber communicating with said first chamber for receiving the pressure therein, a fifth chamber communicating with said venturi for receiving the venturi vacuum therefrom, a sixth chamber communicating with the atmosphere, a seventh chamber communicating with said second chamber, a second flexible diaphragm separating said fourth and fifth chambers from each other, a third flexible diaphragm separating said fifth and sixth chambers from each other a fourth flexible diaphragm separating said sixth and seventh chambers from each other and fixedly connected to said third diaphragm and formed therethrough with an aperture which provides communication between said sixth and seventh chambers, passage means communicating with a vacuum source and having an open end located in said seventh chamber and near said aperture and able to project into said sixth chamber through said aperture, a control valve disposed in said sixth chamber movably relative to said aperture and said open end to close and open same, a spring pressing said control valve against said fourth diaphragm so that said control valve closes said aperture and is moved by said third and fourth diaphragms in one direction to increase the degree of opening of said open end in accordance with increases in a venturi vacuum in said fifth chamber above a second predetermined value and said control valve closes said open end and is moved by said third and fourth diaphragms in another direction to be moved by said passage means to increase the degree of opening of said aperture in accordance with decreases in a venturi vacuum in said fifth chamber below said second predetermined value, and a lever rotatably located in said fifth chamber and engaging against said third diaphragm, said second diaphragm being operatively connected to said lever so that said lever causes said third and fourth diaphragms to move said control valve in said one direction with said control valve closing said aperture in accordance with increases in a pressure in said fourth chamber above a third predetermined value and in said another direction with said control valve opening said aperture in accordance with decreases in a pressure in said fourth chamber below said third predetermined value.

* * * * *